US008083615B2

(12) United States Patent
Wood et al.

(10) Patent No.: US 8,083,615 B2
(45) Date of Patent: Dec. 27, 2011

(54) SET OF GOLF TEES

(75) Inventors: Paul D. Wood, Phoenix, AZ (US); Gregory J. Swartz, Phoenix, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 326 days.

(21) Appl. No.: 12/049,173

(22) Filed: Mar. 14, 2008

(65) Prior Publication Data

US 2009/0233734 A1 Sep. 17, 2009

(51) Int. Cl.
*A63B 57/00* (2006.01)

(52) U.S. Cl. ..... 473/387; 473/390

(58) Field of Classification Search ..... 473/387–403
See application file for complete search history.

(56) References Cited

U.S. PATENT DOCUMENTS

| | | | | |
|---|---|---|---|---|
| 1,522,544 | A * | 1/1925 | Pryde | 473/402 |
| 1,599,207 | A | 9/1926 | Capen, Jr. | |
| 1,600,297 | A * | 9/1926 | Parkhill | 473/400 |
| 1,959,347 | A * | 5/1934 | Czichos | 473/401 |
| 2,589,763 | A * | 3/1952 | Barrett | 473/391 |
| 2,839,304 | A | 6/1958 | Lerick | |
| 3,254,890 | A * | 6/1966 | Watson | 473/396 |
| 3,414,268 | A * | 12/1968 | Chase | 473/396 |
| 3,575,420 | A | 4/1971 | Turner et al. | |
| 3,606,344 | A * | 9/1971 | Ball | 473/398 |
| 3,747,927 | A * | 7/1973 | Hoffman | 473/402 |
| 3,947,027 | A | 3/1976 | Brown | |
| 4,418,909 | A * | 12/1983 | Messana | 473/396 |
| 5,372,362 | A * | 12/1994 | Barker | 473/391 |
| 5,505,444 | A | 4/1996 | Bouclin | |
| 6,267,235 | B1 | 7/2001 | Matias | |
| 2002/0123396 | A1 * | 9/2002 | Joo | 473/393 |
| 2004/0067802 | A1 | 4/2004 | Salsman | |
| 2004/0248673 | A1 * | 12/2004 | Breton | 473/387 |
| 2005/0059511 | A1 | 3/2005 | Chernetsky | |
| 2007/0004538 | A1 * | 1/2007 | Lim | 473/387 |

* cited by examiner

*Primary Examiner* — Steven Wong

(57) ABSTRACT

A set of golf tees that includes at least a low spin golf tee and a high spin golf tee. The low spin golf tee is constructed in a manner to provide decreased resistance to the deformation of a golf ball that is impacted by a golf club while resting on the low spin golf tee. The high spin golf tee is constructed in a manner to provide increased resistance to the deformation of a golf ball that is impacted by a golf club while resting on the high spin golf tee.

21 Claims, 5 Drawing Sheets

SET OF GOLF TEES

BACKGROUND

This invention relates generally to golf equipment and, in particular, to golf tees.

Golf tees are used to support golf balls above the ground on tee shots. When a golf ball resting on a golf tee is struck by a golf club, the golf ball is deformed and the golf tee is pushed downward resulting in resistance between the ground and the golf tee. This resistance produces an opposing force which pushes the golf ball upward. The golf ball is in contact with face of the golf club and when pushed upward results in some increased level of back spin on the golf ball as it leaves the club face. If the resistance is increased, the spin rate of the golf ball will increase. Conversely, if the resistance is decreased, the spin rate of the golf ball will decrease.

DRAWINGS

Figure 4:
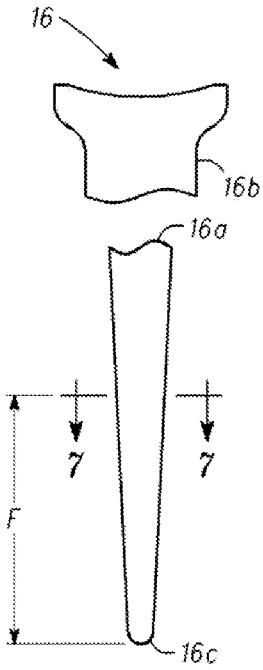
FIGS. 4, 5 and 6 show a set of golf tees according to another embodiment of the present invention.
Figure 5:
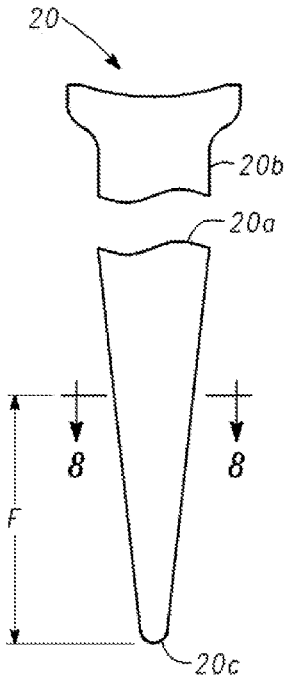
Figure 6:
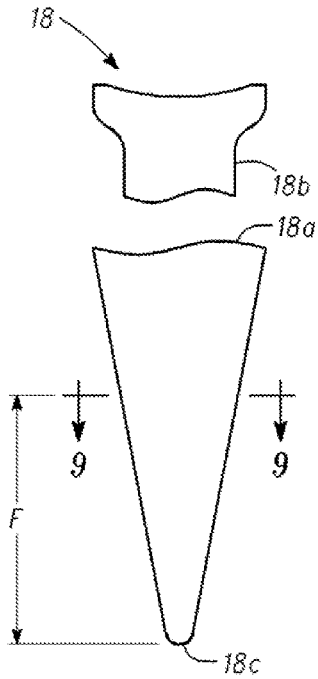
Figure 7:
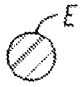
Figure 8:
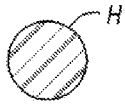
Figure 9:
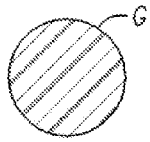
Figure 10:
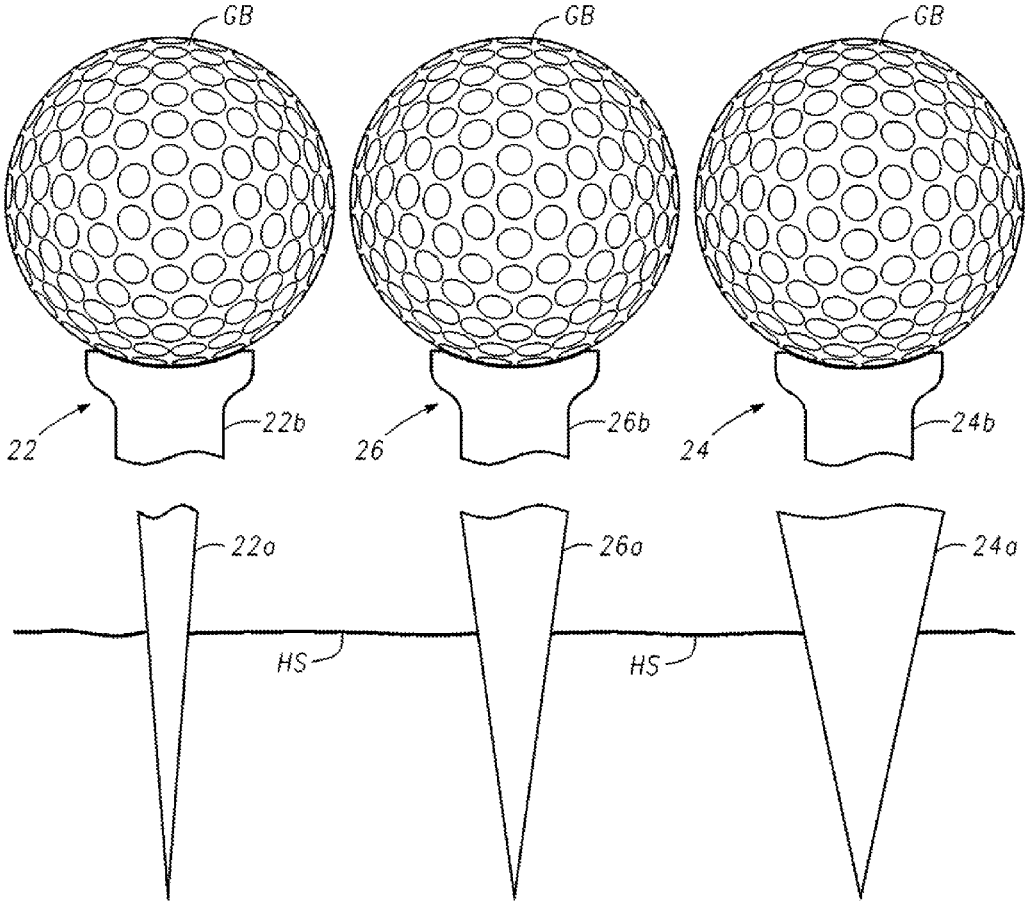

FIGS. 7, 8 and 9 are horizontal cross sectional views taken on lines 7-7, 8-8 and 9-9, respectively, in FIGS. 4, 5 and 6; and FIG. 10 shows a set of golf tees according to a further embodiment of the present invention.

Figure 11:
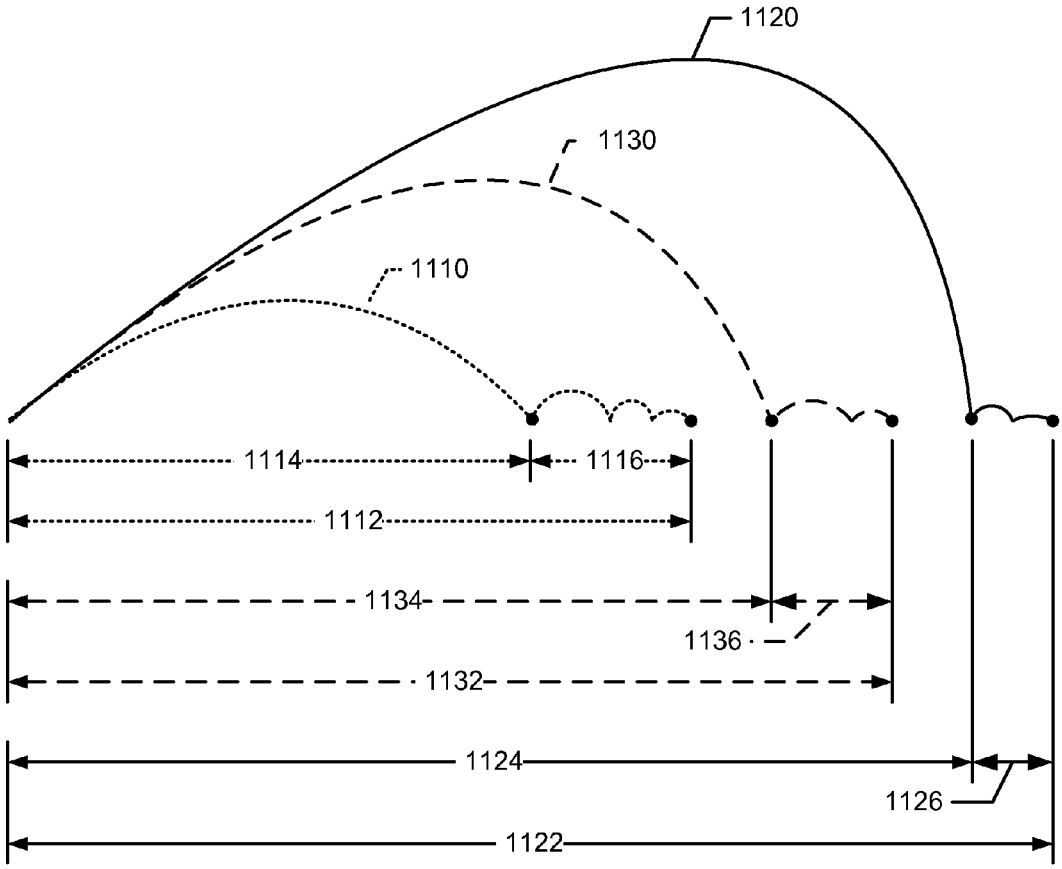

FIG. 11 depicts one example of ball flight trajectories associated with a set of golf tees.

Figure 12:
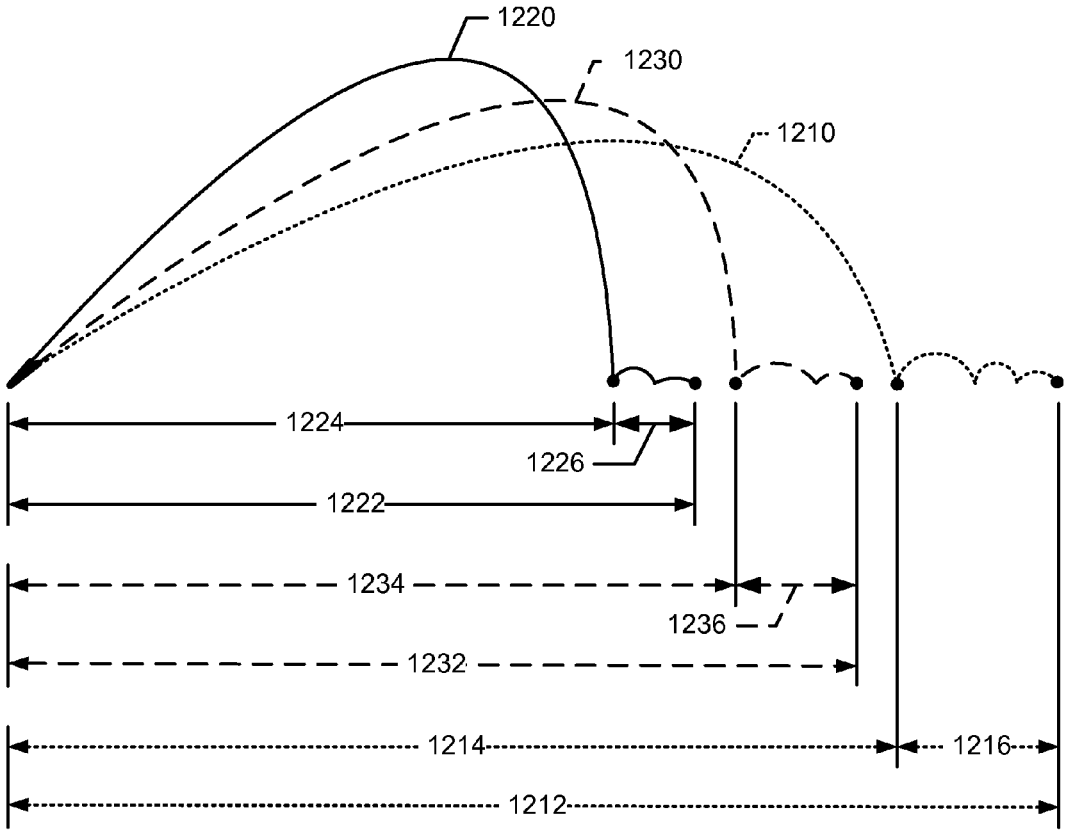

FIG. 12 depicts another example of ball flight trajectories associated with a set of golf tees.

DESCRIPTION

Figure 1:
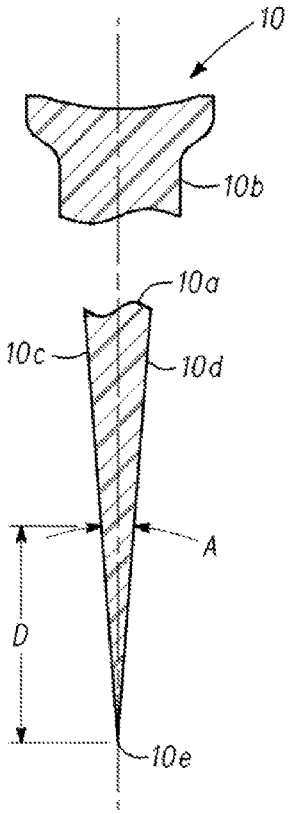
FIGS. 1, 2 and 3 show a set of golf tees according to one embodiment of the present invention.
Figure 2:
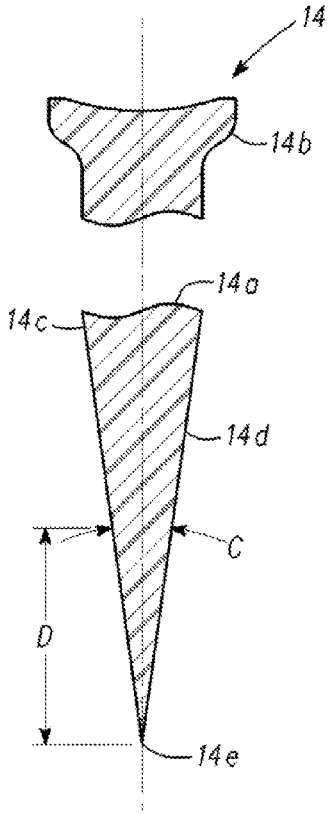
Figure 3:
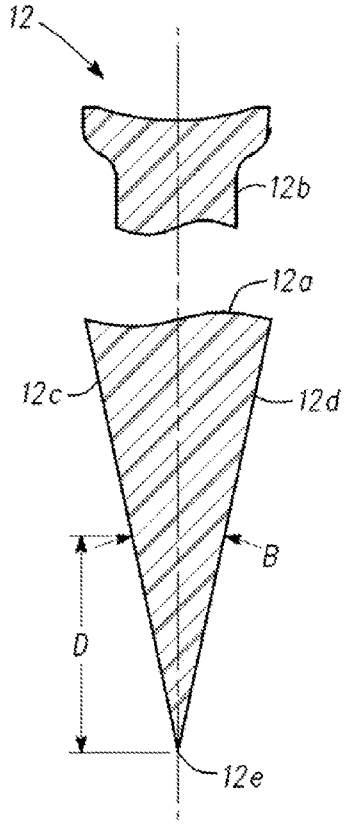

Referring to FIGS. 1, 2 and 3, a set of golf tees includes a golf tee 10, a golf tee 12 and a golf tee 14. Golf tees 10, 12 and 14 have lower portions 10*a*, 12*a* and 14*a*, respectively, for insertion into a holding surface such as the ground. Golf tees 10, 12 and 14 also have upper portions 10*b*, 12*b* and 14*b*, respectively, for supporting a golf ball. Certain portions of the golf tees 10, 12 and 14 that are located between the lower portions 10*a*, 12*a*, 14*a* and the upper portions 10*b*, 12*b*, 14*b* are broken away (not shown) in FIGS. 1, 2 and 3.

The lower portion 10*a* of the golf tee 10 has opposite side edges 10*c* and 10*d* that are (when viewed in vertical cross section) disposed at an angle A with respect to each other when measured at a predetermined distance D from its tip 10*e*. The lower portion 12*a* of the golf tee 12 has opposite side edges 12*c* and 12*d* that are (when viewed in vertical cross section) disposed at an angle B when measured at the same predetermined distance D from its tip 12*e*. The angle B is greater than the angle A. The lower portion 14*a* of the golf tee 14 has opposite side edges 14*c* and 14*d* that are (when viewed in vertical cross section) disposed at an angle C when measured at the same predetermined distance D from its tip 14*e*. The angle C is greater than the angle A but less than the angle B. As described in detail below, the angles A, B, and C may affect the spin rates of the golf tees 10, 12, and 14, respectively.

It will be understood that the first golf tee 10 produces a first spin rate (e.g., revolutions per minute (rpm)) for a golf ball that is impacted by a golf club while being supported on its upper portion 10*b*. The second golf tee 12 produces a second spin rate for a golf ball that is impacted by a golf club while being supported on its upper portion 12*b*. The second spin rate is greater than the first spin rate. The third golf tee 14 produces a third spin rate for a golf ball that is impacted by a golf club while being supported on its upper portion 14*b*. The third spin rate is greater than the first spin rate but less than the second spin rate.

As noted above, the first spin rate may be less than the second and third spin rates. The spin rate of a golf tee may affect the distance and the height traveled by a golf ball after being struck by a golf club. In the example of FIG. 11, each of the golf tees 10, 12, and 14 may be associated with a ball flight trajectory, generally shown as 1110, 1120, and 1130, respectively. While the ball flight trajectories 1110, 1120, and 1130 may have the same ball launch angle, the ball flight trajectories 1110, 1120, and 1130 may differ in total distance, carry distance, and/or roll-out distance.

The ball flight trajectories 1110, 1120, and 1130 may be associated with an individual who generally produces relatively less spin on a golf ball. In particular, a golf ball struck by a golf club off of the first golf tee 10 may be associated with the first ball flight trajectory 1110, which may have a first total distance 1112 including a first carry distance 1114 and a first roll-out distance 1116 (e.g., the first carry distance 1114 plus the first roll-out distance 1116 equals the first total distance 1112). A golf ball struck by a golf club off of the second golf tee 12 may be associated with the second ball flight trajectory 1120, which may have a second total distance 1122 including a second carry distance 1124 and a second roll-out distance 1126 (e.g., the second carry distance 1124 plus the second roll-out distance 1126 equals the second total distance 1122). A golf ball struck by a golf club off of the third golf tee 14 may be associated with the third ball flight trajectory 1130, which may have a third total distance 1132 including a third carry distance 1134 and a third roll-out distance 1136 (e.g., the third carry distance 1134 plus the third roll-out distance 1136 equals the third total distance 1132). As a result, the first golf tee 10 may provide relatively less carry distance but more roll-out distance than either the second golf tee 12 or the third golf tee 14 whereas the second golf tee 12 may provide relatively more total distance (e.g., carry distance plus roll-out distance) than either the first golf tee 10 or the third golf tee 14.

Air resistance and rotational velocity of the golf ball during ball flight may affect the lift (i.e., Magnus force) of the golf ball. The lift of the golf ball may affect to the total distance traveled by the golf ball. Accordingly, the first golf tee 10 may provide less lift than either the second golf tee 12 or the third golf tee 14. Further, wind may reduce the amount of lift on the golf ball. In one example, an individual may use the first golf tee 10 instead of either the second golf tee 12 or the third golf tee 14 when he or she is hitting a golf ball into or against the wind because the first golf tee 10 may provide relatively less lift than either the second golf tee 12 or the third golf tee 14. In contrast, an individual may use the second golf tee 12 instead of either the first golf tee 10 or the third golf tee 14 when he or she is hitting a golf ball with the wind because the second golf tee 12 may provide relatively greater lift than either the first golf tee 10 or the third golf tee 14.

While FIG. 11 may depict the ball flight trajectories 1110, 1120, and 1130 to be sequential in distance relative to each other, the ball flight trajectories 1110, 1120, and/or 1130 may overlap with each other. Further, although FIG. 11 may depict the golf tees 10, 12, and 14 being associated with particular ball flight trajectories, the golf tees 10, 12, and 14 may be associated with other ball flight trajectories as described in detail below.

Turning to FIG. 12, for example, an individual with relatively higher swing speed (e.g., more than 100 mph club head speed) may produce ball flight trajectories 1210, 1220, and 1230 when striking a golf ball with a golf club off of the golf tees, 10, 12, and 14, respectively. While the ball flight trajectories 1210, 1220, and 1230 may have the same ball launch angle, the ball flight trajectories 1210, 1220, and 1230 may differ in total distance, carry distance, and/or roll-out distance. Further, although FIG. 12 may depict the ball flight trajectories 1210, 1220, and 1230 to be sequential in distance relative to each other, the ball flight trajectories 1210, 1220, and/or 1230 may overlap with each other.

The ball flight trajectories 1210, 1120, and 1230 may be associated with an individual who generally produces relatively more spin on a golf ball. In particular, a golf ball struck by a golf club off of the first golf tee 10 may be associated with the first ball flight trajectory 1210, which may have a first total distance 1212 including a first carry distance 1214 and a first roll-out distance 1216 (e.g., the first carry distance 1214 plus the first roll-out distance 1216 equals the first total distance 1212). A golf ball struck by a golf club off of the second golf tee 12 may be associated with the second ball flight trajectory 1220, which may have a second total distance 1222 including a second carry distance 1224 and a second roll-out distance 1226 (e.g., the second carry distance 1224 plus the second roll-out distance 1226 equals the second total distance 1222). A golf ball struck by a golf club off of the third golf tee 14 may be associated with the third ball flight trajectory 1230, which may have a third total distance 1232 including a third carry distance 1234 and a third roll-out distance 1236 (e.g., the third carry distance 1234 plus the third roll-out distance 1236 equals the third total distance 1232). As a result, the first golf tee 10 may provide relatively more carry distance and roll-out distance than either the second golf tee 12 or the third golf tee 14 whereas the second golf tee 12 may provide relatively more lift than either the first golf tee 10 or the third golf tee 14.

Referring to FIGS. 4, 5 and 6, another set of golf tees includes a golf tee 16, a golf tee 18 and a golf tee 20. Golf tees 16, 18 and 20 have lower portions 16*a*, 18*a* and 20*a*, respectively, for insertion into a holding surface such as the ground. Golf tees 16, 18 and 20 also have upper portions 16*b*, 18*b* and 20*b*, respectively, for supporting a golf ball. Certain portions of the golf tees 16, 18 and 20 that are located between the lower portions 16*a*, 18*a*, 20*a* and the upper portions 16*b*, 18*b*, 20*b* are broken away (not shown) in FIGS. 4, 5 and 6.

The lower portion 16*a* of the golf tee 16 has a tip 16*c* and a horizontal cross sectional area E shown in FIG. 8 located at a predetermined distance F from the tip 16*c*. The lower portion 18*a* of the golf tee 18 has a tip 18*c* and a horizontal cross sectional area G shown in FIG. 9 located at the same predetermined distance F from the tip 18*c*. The horizontal cross sectional area G is greater than the horizontal cross sectional area E. The lower portion 20*a* of the golf tee 20 has a tip 20*c* and a horizontal cross sectional area H shown in FIG. 8 located at the same predetermined distance F from the tip 20*c*. The horizontal cross sectional area H is greater than the horizontal cross sectional area E but less than the horizontal cross sectional area G.

It will be understood that the golf tee 16 produces a first spin rate for a golf ball that is impacted by a golf club while being supported on its upper portion 16*b*. Golf tee 18 produces a second spin rate for a golf ball that is impacted by a golf club while being supported on its upper portion 18*b*. The second spin rate is greater than the first spin rate. The golf tee 20 produces a third spin rate for a golf ball that is impacted by a golf club while being supported on its upper portion 20*b*. The third spin rate is greater than the first spin rate but less than the second spin rate.

Referring to FIG. 10, a further set of golf tees includes a golf tee 22, a golf tee 24 and a golf tee 26. Golf tees 22, 24 and 26 have lower portions 22*a*, 24*a* and 26*a*, respectively, for insertion into a holding surface HS such as the ground. Golf tees 22, 24 and 26 also have upper portions 22*b*, 24*b* and 26*b*, respectively, for supporting a golf ball GB. Certain portions of the golf tees 22, 24 and 26 that are located between the lower portions 22*a*, 24*a*, 26*a* and the upper portions 22*b*, 24*b*, 26*b* are broken away (not shown) in FIG. 10.

The lower portion 22*a* of golf tee 22 has a first geometry that results in a first resistance to being pressed into a holding surface HS such as the ground. The lower portion 24*a* of golf tee 24 has a second geometry that results in a second resistance to being pressed into the holding surface HS. The second resistance is greater than the first resistance. The lower portion 26*a* of golf tee 26 has a third geometry that results in a third resistance to being pressed into the holding surface HS. The third resistance is greater than the first resistance but less than the second resistance.

It will be understood that the golf tee 22 produces a first spin rate for a golf ball that is impacted by a golf club while being supported on its upper portion 22*b*. Golf tee 24 produces a second spin rate for a golf ball that is impacted by a golf club while being supported on its upper portion 24*b*. The second spin rate is greater than the first spin rate. The golf tee 26 produces a third spin rate for a golf ball that is impacted by a golf club while being supported on its upper portion 26*b*. The third spin rate is greater than the first spin rate but less than the second spin rate.

Individuals may generate spin rates of a golf ball that vary from, for example, 1500 to 5000 rpm. Accordingly, the golf tee 10 may be referred to as the "low spin rate" golf tee relative to the golf tees 12 and 14 whereas the golf tee 12 may be referred to as the "high spin rate" golf tee relative to the golf tees 10 and 14. The golf tee 14 may be referred to as the "medium spin rate" golf tee relative to the golf tees 10 and 12. In particular, the golf tee 10 may produce about 100 to 200 rpm less than the golf tee 14, which in turn, may produce about 100 to 200 rpm less than the golf tee 12. As a result, the golf tee 10 may produce about 200 to 400 rpm less than the golf tee 12. The golf tees described herein are not limited in this regard.

Following the above example, the golf tee 16 may be referred to as the "low spin rate" golf tee relative to the golf tees 18 and 20 whereas the golf tee 18 may be referred to as the "high spin rate" golf tee relative to the golf tees 16 and 20. Accordingly, the golf tee 20 may be referred to as the "medium spin rate" golf tee relative to the golf tees 16 and 18. In particular, the golf tee 16 may produce about 100 to 200 rpm less than the golf tee 20, which in turn, may produce about 100 to 200 rpm less than the golf tee 18. As a result, the golf tee 16 may produce about 200 to 400 rpm less than the golf tee 18.

In a similar manner, the golf tee 22 may be referred to as the "low spin rate" golf tee relative to the golf tees 24 and 26 whereas the golf tee 24 may be referred to as the "high spin rate" golf tee relative to the golf tees 22 and 26. Accordingly, the golf tee 26 may be referred to as the "medium spin rate" golf tee relative to the golf tees 22 and 24. In particular, the golf tee 22 may produce about 100 to 200 rpm less than the golf tee 26, which in turn, may produce about 100 to 200 rpm less than the golf tee 24. As a result, the golf tee 22 may produce about 200 to 400 rpm less than the golf tee 24.

Golf tees 10, 16 and 22 may offer less resistance to the downward push of a golf ball (that is struck by a golf club while being supported by the golf tee) than golf tees 14, 20 and 26, respectively, which results in the golf ball having less spin. Golf tees 12, 18 and 24 may offer more resistance to a golf ball (that is struck by a golf club while being supported by the golf tee) than golf tees 14, 20, and 26, respectively, which may result in the golf ball having more spin.

Golf tees 10, 12, 14, 16, 18, 20, 22, 24 and 26 may made of suitable material such as wood, plastic, rubber, graphite or any combination thereof. Further, although FIGS. 7-9 may depict a particular horizontal, cross-sectional shape, the golf tees described herein may have other suitable horizontal, cross-sectional shapes (e.g., oval-shaped, triangle-shaped, square-shaped, rectangle-shaped, etc.).

For the sake of this example, it will be understood that golf tees 10, 12, 14, 16, 18, 20, 22, 24 and 26 each have an overall length dimension with these overall length dimensions of golf tees 10, 12, 14, 16, 18, 20, 22, 24 and 26 being substantially equal. Although the figures may depict the golf tees 10, 12, and 14 having substantially the same length, the dimensions of the golf tees described herein may vary. For example, the length of the golf tees 10, 12, and/or 14 may be different to provide different spin characteristics.

What is claimed is:

1. A set of golf tees comprising:

a first golf tee having a lower portion for insertion into a holding surface and an upper portion for supporting a golf ball, the lower portion of the first golf tee having a tip, the lower portion of the first golf tee, when viewed in vertical cross section, having opposite side edges that are disposed at a first angle with respect to each other when measured at a predetermined distance from the tip of the first golf tee;

a second golf tee having a lower portion for insertion into the holding surface and an upper portion for supporting the golf ball, the lower portion of the second golf tee having a tip, the lower portion of the second golf tee, when viewed in vertical cross section, having opposite side edges that are disposed at a second angle with respect to each other when measured at the predetermined distance from the tip of the second golf tee; and a third golf tee having a lower portion for insertion into the holding surface and an upper portion for supporting the golf ball, the lower portion of the third golf tee having a tip, the lower portion of the third golf tee, when viewed in vertical cross section, having opposite side edges that are disposed at a third angle with respect to each other when measured at the predetermined distance from the tip of the third golf tee, wherein:

the second angle being greater than the first angle;

the third angle being greater than the first angle but less than the second angle;

the first golf tee produces a first spin rate for the golf ball that is impacted by a golf club while being supported by the upper portion of the first golf tee;

the second golf tee produces a second spin rate for the golf ball that is impacted by the golf club while being supported by the upper portion of the second golf tee;

the second spin rate is greater than the first spin rate;

the first golf tee has a first length dimension;

the second golf tee has a second length dimension;

the first length dimension is equal to the second length dimension; and a shape of the upper portion of the first golf tee is substantially similar to a shape of the upper portion of the second golf tee.

2. The set of golf tees of claim 1, wherein the third golf tee produces a third spin rate for the golf ball that is impacted by the golf club while being supported by the upper portion of the third golf tee, and the third spin rate is greater than the first spin rate and less than the second spin rate.

3. The set of golf tees of claim 2, wherein the third golf tee has a third length dimension, and the third length dimension is equal to the first length dimension and the second length dimension.

4. A set of golf tees comprising:

a first golf tee having a lower portion for insertion into a holding surface and an upper portion for supporting a golf ball, the lower portion of the first golf tee having a tip and a first horizontal cross sectional area located at a predetermined distance from the tip of the first golf tee;

a second golf tee having a lower portion for insertion into the holding surface and an upper portion for supporting the golf ball, the lower portion of the second golf tee having a tip and a second horizontal cross sectional area located at the predetermined distance from the tip of the second golf tee; and a third golf tee having a lower portion for insertion into the holding surface and an upper portion for supporting the golf ball, the lower portion of the third golf tee having a tip and a third horizontal cross sectional area located at the predetermined distance from the tip of the third golf tee, wherein:

the second horizontal cross sectional area being greater than the first horizontal cross sectional area;

the third horizontal cross sectional area being greater than the first horizontal cross sectional area but less than the second horizontal cross sectional area;

the first golf tee produces a first spin rate for the golf ball that is impacted by a golf club while being supported by the upper portion of the first golf tee;

the second golf tee produces a second spin rate for the golf ball that is impacted by the golf club while being supported by the upper portion of the second golf tee;

the second spin rate is greater than the first spin rate;

the first golf tee has a first length dimension;

the second golf tee has a second length dimension;

the first length dimension is equal to the second length dimension;

a shape of the bottom portion of the first golf tee is substantially similar to a shape of the bottom portion of the second golf tee except for the second horizontal cross sectional area being greater than the first horizontal cross sectional area; and a shape of the upper portion of the first golf tee is substantially similar to a shape of the upper portion of the second golf tee.

5. The set of golf tees of claim 4, wherein the third golf tee produces a third spin rate for the golf ball that is impacted by the golf club while being supported by the upper portion of the third golf tee, and the third spin rate is greater than the first spin rate but less than the second spin rate.

6. The set of golf tees of claim 5, the third golf tee has a third length dimension, and the third length dimension is equal to the first length dimension and the second length dimension.

7. A set of golf tees comprising:

a first golf tee having an upper portion for supporting a golf ball and a lower portion for insertion into a holding surface, the lower portion of the first golf tee having a first geometry that results in a first resistance to being pressed into the holding surface;

a second golf tee having an upper portion for supporting the golf ball and a lower portion for insertion into the holding surface, the lower portion of the second golf tee having a second geometry that results in a second resistance to being pressed into the holding surface; and a third golf tee having a lower portion for insertion into the holding surface and an upper portion for supporting the golf ball, the lower portion of the third golf tee having a third geometry that results in a third resistance to being pressed into the holding surface;

wherein:

the second resistance being greater than the first resistance;

the third resistance being greater than the first resistance but less than the second resistance;

the first golf tee produces a first spin rate for the golf ball that is impacted by a golf club while being supported by the upper portion of the first golf tee;

the second golf tee produces a second spin rate for the golf ball that is impacted by the golf club while being supported by the upper portion of the second golf tee;

the third golf tee produces a third spin rate for the golf ball that is impacted by the golf club while being supported by the upper portion of the third golf tee, and the third spin rate is greater than the first spin rate and less than the second spin rate;

the second spin rate is greater than the first spin rate;

the first golf tee has a first length dimension;

the second golf tee has a second length dimension;

the first length dimension is equal to the second length dimension;

the third golf tee has a third length dimension, and the third length dimension is equal to the first length dimension and the second length dimension;

the lower portion of the first golf tee is substantially symmetric about a first axis running through a center of the lower portion of the first golf tee;

the lower portion of the second golf tee is substantially symmetric about a second axis running through a center of the lower portion of the second golf tee;

the lower portion of the third golf tee is substantially symmetric about a third axis running through a center of the lower portion of the third golf tee;

the upper and lower portions of the first golf tee consist of identical material or materials with each other;

the upper and lower portions of the second golf tee consist of identical material or materials with each other and with the identical material or materials of the first golf tee;

the upper and lower portions of the third golf tee consist of identical material or materials with each other and with the identical material or materials of the first and second golf tees;

a shape of the lower portion of the first golf tee except for the first geometry is substantially similar to a shape of the lower portion of the second golf tee;

a shape of the lower portion of the third golf tee except for the third geometry is substantially similar to the shape of the lower portion of the first golf tee;

the shape of the lower portion of the third golf tee except for the third geometry is substantially similar to the shape of the lower portion of the second golf tee;

a shape of the upper portion of the first golf tee is substantially similar to a shape of the upper portion of the second golf tee;

a shape of the upper portion of the third golf tee is substantially similar to the shape of the upper portion of the first golf tee; and the shape of the upper portion of the third golf tee is substantially similar to the shape of the upper portion of the second golf tee.

8. The set of golf tees of claim 1, wherein:

the first angle is substantially constant throughout the lower portion of the first golf tee; and the second angle is substantially constant throughout the lower portion of the second golf tee.

9. The set of golf tees of claim 1, wherein:

the lower portion of the first golf tee is substantially symmetric about a first axis running through a center of the lower portion of the first golf tee; and the lower portion of the second golf tee is substantially symmetric about a second axis running through a center of the lower portion of the second golf tee.

10. The set of golf tees of claim 1, wherein:

the first golf tee is substantially symmetric about a first axis running through a center of the first golf tee; and the second golf tee is substantially symmetric about a second axis running through a center of the second golf tee.

11. The set of golf tees of claim 4, wherein:

the lower portion of the first golf tee is substantially symmetric about a first axis running through a center of the lower portion of the first golf tee; and the lower portion of the second golf tee is substantially symmetric about a second axis running through a center of the lower portion of the second golf tee.

12. The set of golf tees of claim 4, wherein:

the first golf tee is substantially symmetric about a first axis running through a center of the first golf tee; and the second golf tee is substantially symmetric about a second axis running through a center of the second golf tee.

13. The set of golf tees of claim 6, wherein:

the lower portion of the third golf tee is substantially symmetric about a third axis running through a center of the lower portion of the third golf tee.

14. The set of golf tees of claim 1, wherein:

a shape of the lower portion of the first tee is substantially similar to a shape of the lower portion of the second tee except the second angle is greater than the first angle.

15. The set of golf tees of claim 1, wherein:

the first golf tee consists of a first material; and the second golf tee consists of the first material.

16. The set of golf tees of claim 15, wherein:

the first material is wood.

17. The set of golf tees of claim 15, wherein:

the first material is a plastic.

18. The set of golf tees of claim 4, wherein:

the first golf tee consists of a first material; and the second golf tee consists of the first material.

19. The set of golf tees of claim 18, wherein:

the first material is wood.

20. The set of golf tees of claim 1, wherein:

a shape of the upper portion of the third golf tee is substantially similar to the shape of the upper portion of the first golf tee and the shape of the upper portion of the second golf tee.

21. The set of golf tees of claim 4, wherein:

the shape of the bottom portion of the first golf tee is substantially similar to a shape of the bottom portion of the third golf tee except for the third horizontal cross sectional area being greater than the first horizontal cross sectional area;

the shape of the upper portion of the first golf tee is substantially similar to a shape of the upper portion of the third golf tee;

the shape of the bottom portion of the second golf tee is substantially similar to the shape of the bottom portion of the third golf tee except for the second horizontal cross sectional area being greater than the third horizontal cross sectional area; and the shape of the upper portion of the second golf tee is substantially similar to the shape of the upper portion of the third golf tee.

* * * * *